US005148850A

United States Patent [19]

Urbanick

[11] Patent Number: 5,148,850

[45] Date of Patent: Sep. 22, 1992

[54] WEATHERPROOF CONTINUOUS HINGE CONNECTOR FOR ARTICULATED VEHICULAR OVERHEAD DOORS

[75] Inventor: Burton A. Urbanick, Gainesville, Ga.

[73] Assignee: Paneltech Ltd., Gainesville, Ga.

[21] Appl. No.: 638,199

[22] Filed: Jan. 4, 1991

Related U.S. Application Data

[63] Continuation-in-part of Ser. No. 373,142, Jun. 28, 1989, abandoned.

[51] Int. Cl.[5] ..... E06B 3/48

[52] U.S. Cl. ..... 160/231.1; 16/225; 160/201; 160/229.1

[58] Field of Search ..... 160/229.1, 201, 231.1, 160/231.2; 16/224, 355, 97, 225; 49/383, 397; 24/587; 301/112, 113, 121, 122

[56] References Cited

U.S. PATENT DOCUMENTS

| | | | |
|---|---|---|---|
| 3,148,724 | 9/1964 | Chieger et al. . | |
| 3,326,268 | 6/1967 | Dixon | 160/231.2 |
| 4,532,973 | 8/1985 | DeFalco | 160/201 |
| 4,681,379 | 7/1987 | Pillinini | 160/229.1 X |
| 4,765,646 | 8/1988 | Cheng | 301/113 X |
| 4,995,441 | 2/1991 | Leist et al. | 160/229.1 |

*Primary Examiner*—Blair M. Johnson

*Attorney, Agent, or Firm*—Ruden, Barnett, McClosky, Smith, Schuster & Russell

[57] ABSTRACT

A new dynamic shock-resistant flexible sealing hinge connector comprising members associated with adjacent door panels and an elongated, shock-absorbing elastomeric connector member engaging the rigid members such that the elastomeric connector member dynamically seals and rotatably joins the door panels.

16 Claims, 3 Drawing Sheets

WEATHERPROOF CONTINUOUS HINGE CONNECTOR FOR ARTICULATED VEHICULAR OVERHEAD DOORS

This is a continuation-in-part of Ser. No. 07/373,142 filed Jun. 28, 1989 now abandoned.

BACKGROUND OF THE INVENTION

This invention relates to articulated doors comprising rectilinear, horizontally joined panels capable of articulately opening and closing and, more particularly, to weatherproof, shock-resistant and readily serviceable continuous flexible hinges for articulated vehicular doors subject to harsh "over-the-road" conditions.

Articulated doors find application in many areas, including garage doors and as doors in over-the-road vehicles. This application is concerned not with articulated garage type doors, which operate in a relatively static environment, but rather with articulated vehicular doors for over-the-road cargo containers, semi-trailer vans and truck bodies which operate in a radically different, dynamic environment. Such vehicular doors are designed to move in parallel tracks from an "overhead" or open, horizontal position below the roof of the container, van or truck body to a "closed" vertical position meeting the floor of the container, van or truck when the container is closed. Articulated doors used in such dynamic environments are subject to devastatingly harsh treatment including heavy jostling and harmonic motion when travelling over-the-road, frequent opening and closing at stops each time goods are moved in and out, as well as nearly continuous exposure to the elements. Dynamic seals which resist the jostling and harmonic motion, the frequent and rough use and the exposure to the elements are needed in such dynamic environments.

Hinges of the type typically used today in such dynamic environments include conventional metallic hinges bolted to pairs of adjacent door panels which naturally require periodic lubrication and, more importantly are subject to friction and wear under the harmonic stresses of over-the-road vibrations. Such hinges typically protrude from the inside surface of the door into the vehicle body, and can hang up on cargo, preventing opening of the door and damaging goods which move against the door during shipment. Additionally, it is time-consuming and expensive to remove these hinges in order to replace damaged door panels.

Conventional hinges used in such overhead doors do not absorb shock. Also, they do not provide a moisture barrier, which is particularly important in shipping moisture-sensitive goods. Furthermore, even if a separate moisture barrier were installed between adjacent door panels, dynamic stresses at through-holes for the fasteners holding the hinges in place still prevent a durable dynamic seal. Additionally, the through fasteners themselves, since they are directly exposed on the outer surface of the door, are subject to corrosion and subsequently cause deterioration at fastener holes where vibration stresses are absorbed.

SUMMARY OF THE INVENTION

Accordingly, it is an object of the invention to provide a dynamic, shock-resistant flexible continuous weatherproof hinge for articulated vehicular doors for "over-the-road" vehicles such as cargo containers, semi-trailer vans and trucks.

A further object of the present invention is to provide a new and unique flexible hinge for articulated doors used on such vehicles which is held in place without through fasteners and provides a dynamic weatherproof seal between adjacent panels of the doors.

It is yet another object of the present invention to provide a weatherproof, shock-resistant flexible continuous hinge for articulated vehicular doors used on "over-the-road" cargo containers, semi-trailer vans and trucks which may be opened and closed by moving upwardly and downwardly in parallel tracks.

It is still another object of the present invention to provide a weatherproof, shock-resistant flexible hinge for articulated doors used on "over-the-road" vehicles which presents a smooth, relatively flush interior and exterior surface free of bolt and rivet heads.

A still further object of the invention is to provide articulated vehicular doors which can be simply and quickly assembled and disassembled by "snapping in" and "peeling out" an elastomeric connector member joining adjacent door panels.

It is still a further object of the present invention to provide an improved articulated vehicular overhead door for "over-the-road" vehicles.

Other objects and features of the invention will become apparent upon examination of the following specification and drawings, together with the claims. While the invention is described below in connection with preferred or illustrative embodiments, these embodiments are not intended to be exhaustive or limiting of the invention. Rather, the invention is intended to cover any alternatives, modifications, and equivalents that may be included within its spirit and scope as defined by the appended claims.

The present invention comprises a resilient, elastomeric, continuous sealing hinge connector for an articulated door for use in an over-the-road vehicle and to such specialized articulated doors themselves.

The resilient, elastomeric continuous sealing hinge connector of the invention comprises a pair of rigid members which are associated with adjacent edges of door panels, either as rigidly connected independent elements or as integrally formed features of the door panels themselves. The first rigid member has a longitudinally disposed convex surface and the second rigid member has a generally concave surface generally mirroring the convex surface of the first rigid member. The rigid members are joined by an elongated elastomeric connector member. The elongated elastomeric connector member is generally equal in length to the width of the corresponding articulated door panels, holding the panels together and permitting adjacent panels to rotate sequentially effecting hinge action at the elastomeric connector member, when the door is opened or closed.

BRIEF DESCRIPTION OF THE DRAWINGS

The features of this invention which are believed to be novel are set forth with particularity in the appended claims. The invention, together with its objects and advantages may be best understood by reference to the following description taken in conjunction with the accompanying drawings, in which like reference numerals identify like elements in the several figures and in which:

DESCRIPTION OF THE PREFERRED EMBODIMENTS

Figure 1:
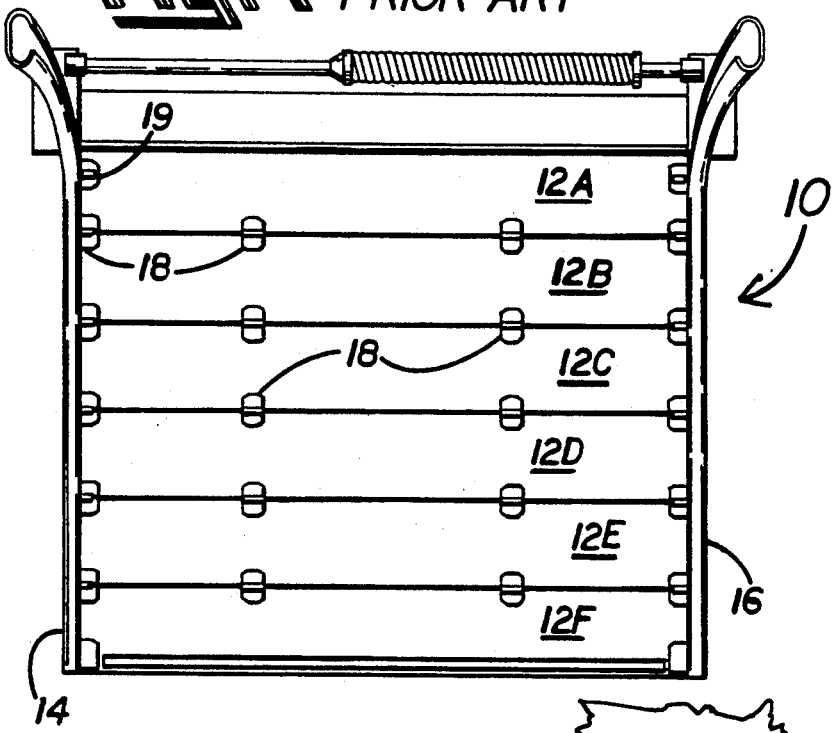
FIG. 1 PRIOR ART
FIG. 1 illustrates an overhead door of the prior art in which numerous metallic hinges join adjacent door panels.

Turning now to FIG. 1, an articulated vehicular overhead door 10 for "over-the-road" cargo containers, semi-trailer vans and trucks is illustrated comprising a series of elongated panels 12A–F on two parallel tracks 14 and 16. Four separate conventional metallic hinges 18 join each pair of elongated panels along their opposite edges. The hinge knuckles 19 protrude from the surface of the door, making it possible, if not likely, that the hinges will hang-up and damage cargo within the enclosure, especially when the doors have to be forced open with lifting devices.

If a panel of the door of FIG. 1 is damaged, removal and replacement is time-consuming and therefore expensive. First, the rivets, bolts or other fasteners holding the hinges to the adjacent panels must be removed and the hinges detached. Then, the damaged panel must be removed, a new panel positioned in its place, hinge holes drilled to receive bolts or rivets, and the hinges attached to the panels.

Figure 2:
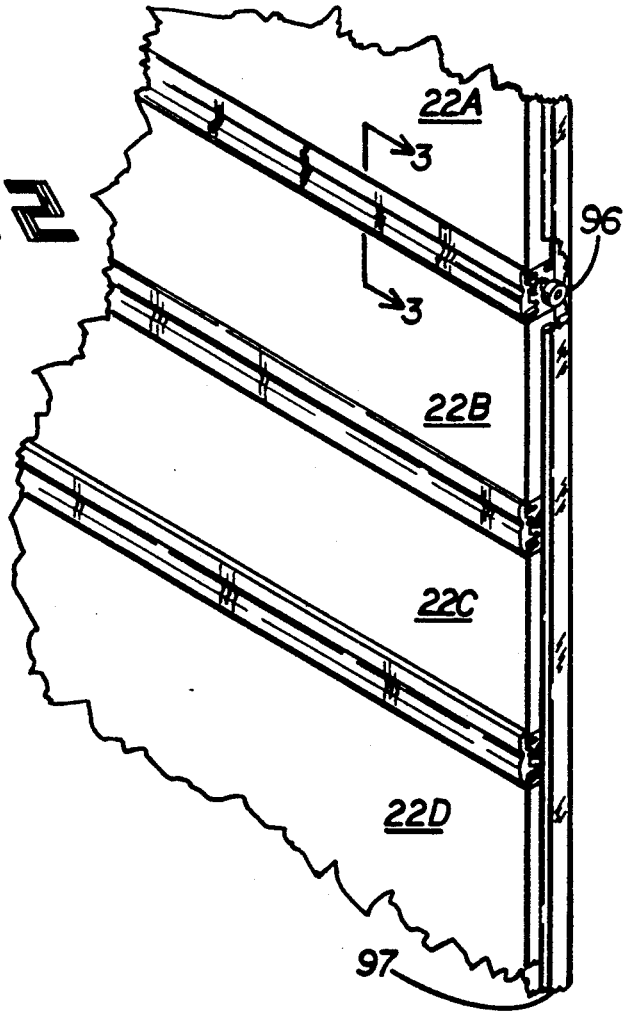
FIG. 2 illustratesan overhead door constructed in accordance with the present invention, viewed, in partial perspective, from the inside of the door.

Turning now to FIG. 2, the smooth flush interior surface of an articulated vehicular door 20 constructed in accordance with the present invention is illustrated. In this figure, door 20 comprises a series of elongated panels 22A–22D joined, as hereinafter explained, by a series of elongated shock-absorbing elastomeric connector members 24.

Figure 3:
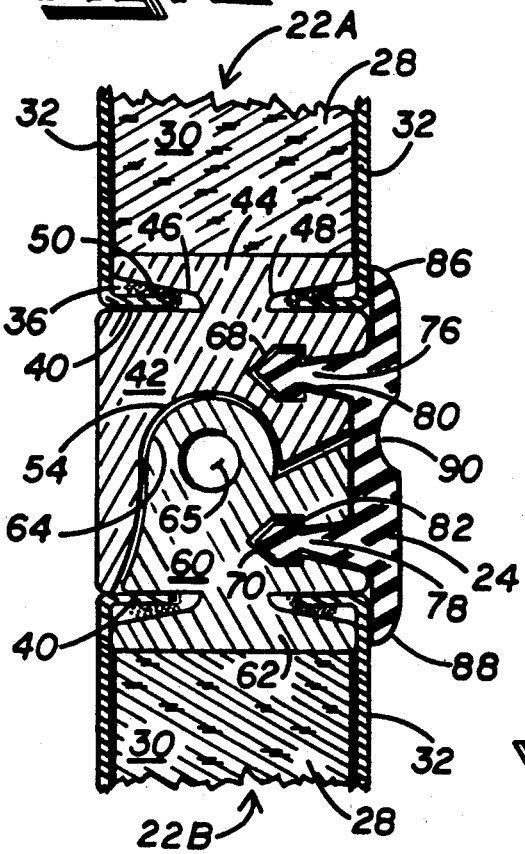
FIG. 3 is an enlarged partial cross-sectional view of two door panels joined by a continuous elastomeric hinge connector of the present invention.

Adjacent door panels 22A and 22B are shown in enlarged section form in FIG. 3. Although the panels may be made of any conventionally available material, in one preferred embodiment illustrated in the FIGURES, stress skin composite panels 28 are used. These panels comprise a high density foam core 30 covered by high-strength aluminum skins 32. In an alternative design, the core is an aluminum honeycomb hexagonal cell structure. Such stress skin composite panels typically are structurally bonded in flat platen presses. Naturally, the invention is not intended to be limited to such composite panels, but may be used with any available types of panels.

A first rigid member 42 is provided with a longitudinal pedestal 44 undercut at 46 and 48. This rigid member is firmly or non-pivotably attached to the core 30 of panel 22A by passing the pedestal into channel 36 with the short legs 40 of the L shaped lips of the aluminum skin engaging undercuts 46 and 48. Additionally, pedestal 44 is optionally bonded with an appropriate adhesive 50 to legs 40 of the L shaped lips of the aluminum skin. The mating of the aluminum skin with the undercuts (and the bonding) insures a rigid attachment of member 42 to panel 22A.

Although the above method of attachment is preferred, any attachment structure which would achieve a generally rigid or non-pivotal connection could be used. While rigid member 42 (as well as rigid member 60, discussed below) is made of extruded aluminum, any rigid or semi-rigid workable material could be used. Finally, as noted earlier, alternatively the rigid members may be integrally formed as part of the panel, as discussed below in connection with FIGS. 6 and 7.

Figure 4:
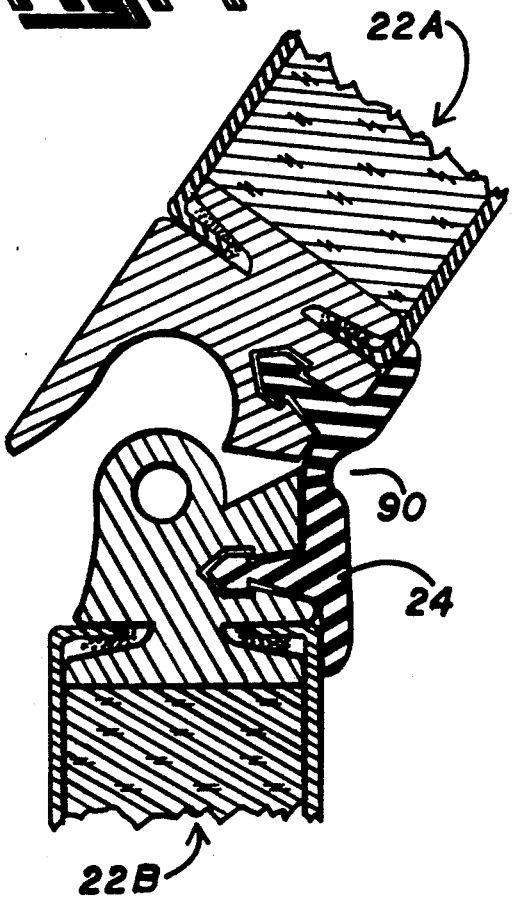
FIG. 4 corresponds generally to FIG. 3, except that adjacent panels have been pivoted at the elastomeric hinge connector, as would be encountered as the door is rolled up or down along the tracks in transition from a vertical to a horizontal plane.
Figure 6:
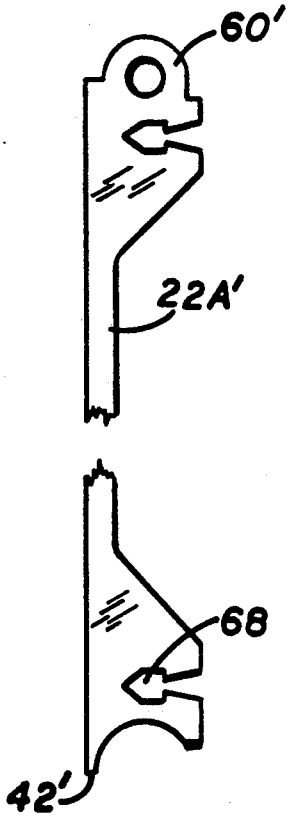
FIG. 6 is a partial cross-sectional view of an alternative door panel having rigid members for engaging the elastomeric element integrally formed as part of the panels.
Figure 7:
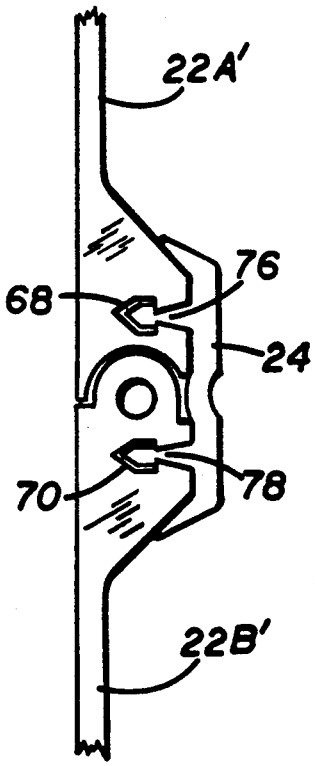
FIG. 7 is a partial cross-sectional view of two door panels as in FIG. 6, joined by a continuous elastomeric hinge connector of the present invention.

Thus, turning to FIG. 6, there is illustrated an elongated panel 22A' with integral first and second rigid members 42' and 60' corresponding respectively to rigid members 42 and 60 in the embodiment of FIGS. 2–4. In FIG. 7, the bottom edge of panel 22A' is positioned next to the top of an identical panel 22B' so that rigid member 42' of panel 22A' is juxtaposed next to rigid member 60' of panel 22B'.

Returning to FIGS. 3 and 4, rigid member 42 extends to the top surface of the lower panel 22B, presenting a flat outer surface when the door is closed, as in FIG. 3. The inner face 54 of the rigid member is generally concave, as shown.

A second rigid member 60 is also provided, in the illustrated embodiment, with a pedestal 62 for attachment to panel 22B in the same fashion as pedestal 44 is attached to panel 22A. Rigid member 60 is designed to present a generally convex portion 64 mirroring the inner surface 54 of rigid member 42. When the door is closed, as shown in FIG. 2, rigid members 42 and 60 will be spaced from each other along their respective outer surfaces 54 and 64. This spacing should preferably be from about 1/32nd of an inch to about 1/16th of an inch.

Rigid members 42 and 60 include respective arrow-shaped openings 68 and 70. In addition, rigid member 60 is provided with a bore 65 to accept the roller guide assembly of FIG. 5, as discussed below.

Elongated shock-absorbing elastomeric connector member 24 includes inwardly directed integral gripping fingers 76 and 78 which are arrow-shaped and dimensioned and positioned to be received in respective arrow-shaped openings 68 and 70. When the gripping fingers are snapped into arrow-shaped openings 68 and 70, the fingers are compressed but return to their initial shape as base 80 of the arrow seats on sills 82 of the openings. The seated gripping fingers thus resist removal and thereby join the adjacent panels while maintaining the desired spacing between the first and second rigid members. Elastomeric member 24 includes sealing lips 86 and 88 which press against panels 22A and 22B to seal against the rear face of panels 22A and 22B.

The outer face of elongated, shock-absorbing elastomeric member 24 is generally smooth and flat, with a longitudinally indentation 90. As best seen in FIG. 4, when the door is opened, longitudinal member bends along indentation 90, permitting a stress-free pivoting of panels 22A and 22B with respect to one another. A weatherproof shock-absorbing seal is thus maintained at all times between panels 22A and 22B by the resilient, elastomeric continuous sealing hinge comprising the combination of the first and second rigid members and the elongated shock-absorbing elastomeric connector member.

Elastomeric connector member 24 is made of an elastomeric material such as ethylene propylene diene modified thermoplastic rubber or polyester butylene terephthalate modified synthetic rubber, or a polyurethane elastomer. In a preferred embodiment, the elastomeric connector member will be made of ethylene propylene diene modified synthetic rubber to provide the dynamic sealing and at the same time carry the tension, compression stresses under all environmental conditions.

Figure 5:
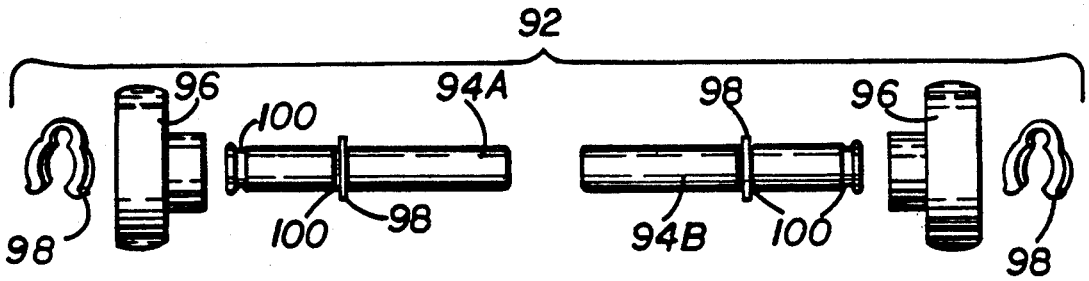
FIG. 5 is a partial, plan view of a roller guide assembly used in attaching door panels to the door tracks with a specially designed clip feature to facilitate the quick assembly and disassembly of individual panels.

A roller guide assembly 92 desirable for use in the invention is illustrated in FIG. 5. This assembly includes stub shafts 94A and 94B which pass through bore 65 in rigid member 60 and rollers 96. Rollers 96 are rotatably attached to the roller shaft clips 98 resting in fillets 100 in the stub shafts. Rollers 96 are seated in track 97, as illustrated in FIG. 2.

If, for example, panel 22B becomes damaged and it becomes necessary to selectively remove and replace panel 22B, it would be necessary simply to peel the elastomeric members from either side of the panel, release the spring clips from the roller guide assembly, and remove the shaft through a hole in the web of the track which releases the rollers and the shaft, freeing the damaged panel. Then, with the shafts installed on the new panel, the new panel is positioned in the space left by the removed panel and the rollers are positioned on shafts in tracks 97, and secured with shaft clips 98. Then the continuous elastomeric member 24 is again snapped into position to quickly and simply complete the replacement operation.

While particular embodiments of the invention have been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. An assembly hingeably and resiliently connecting mutually adjoining first and second panels of an overhead door while effectively damping vibration and sealing the gap between such panels irrespective of whether the door is closed or is fully or partially open, said assembly comprising:

(a) an elongated first member associated with a lateral edge of the first panel, said first member having a first opening and a laterally extending channel formed along at least a portion of its length;

(b) an elongated second member associated with a lateral edge of the second panel which adjoins the first panel, said second member having a second opening and a rail formed along at least a portion of its length, said rail being of a cross-sectional size and shape substantially complimentary to that of said channel so as to be at least partially received within said channel when the door is closed; and (c) an elongated resilient elastomeric member extending across at least a portion of the widths of said first and second panels, said elastomeric member including (i) a body generally in the form of an elongated strip having first and second sealing lips overlying exterior surfaces of said first and second panels, respectively, and (ii) integral first and second projections located between said lips and extending from said body, said first and second projections being removably securable within said first opening of said first member and said second opening of said first member, respectively so as to bias said lips against said exterior surfaces of said panels to form a seal between said lips and said panels along substantially the entire length of said body when said first and second projections are received within said first and second openings, said elastomeric member serving to dampen mechanical vibration while maintaining said seal during operation of the door.

2. The assembly of claim 1 wherein said first and second members are formed integrally with said associated door panels.

3. The assembly of claim 1 wherein said first and second members include flat pedestals for meeting the flat edges of the adjacent door panels.

4. The assembly of claim 1 wherein said first member has a relatively flat outer surface.

5. The assembly of claim 1 wherein said second member has a longitudinal wall defining a longitudinal bore for receiving a roller guide assembly.

6. The assembly of claim 1 wherein said first member has a generally concave surface and said second member has a generally convex surface generally mirroring the inner surface of said first rigid member for exterior surface alignment of said panels when said concave and convex surfaces are engaged.

7. The assembly of claim 1 wherein said elastomeric member is made of ethylene propylene diene modified synthetic rubber.

8. The assembly of claim 1 wherein said first and second projections comprise at least two inwardly directed gripping fingers.

9. The assembly of claim 8 wherein said gripping fingers are arrow-shaped.

10. The assembly of claim 8 wherein said first and second openings are arrow-shaped and said gripping fingers are correspondingly arrow shaped to permit said fingers to securely engage said openings so that said gripping fingers will not wear under opening and closing stress or deteriorate under vibration.

11. The assembly of claim 1 wherein said second member has a pair of opposed ends each of which defines a lateral bore, said assembly further comprising a shaft receivable within said bore, a roller, and a retainer clip for removably securing said roller to said shaft.

12. The assembly of claim 1 wherein said elastomeric member has a longitudinal indentation to relieve stress as said adjacent panels pivot with respect to one another.

13. The assembly of claim 1 wherein said first and second members are spaced from each other between said rail and said channel.

14. The assembly of claim 13 wherein said spacing is from about 1/32nd to about 1/16th of an inch when said rail is fully received within said channel.

15. An overhead door, comprising:

(a) at least one first panel and at least one second panel, said first and second panels mutually adjoining one another along respective lateral edges thereof;

(b) an elongated first member associated with said lateral edge of said first panel, said first member having a first opening and a laterally extending channel formed along at least a portion of its length;

(c) an elongated second member associated with said lateral edge of said second panel, said rail being of a cross-sectional size and shape substantially complimentary to that of said channel so as to be at least partially received within said channel when the door is closed; and (d) an elongated resilient elastomeric member extending across at least a portion of the widths of said first and second panels, said elastomeric member including (i) a body generally in the form of an elongated strip having first and second sealing lips overlying exterior surfaces of said first and second panels, respectively, and (ii) integral first and second projections located between said lips and extending from said body, said first and second projections being removably securable within said first opening of said first member and said second opening of said first member, respectively so as to bias said lips against said exterior surfaces of said panels to form a seal between said lips and said panels along substantially the entire length of said body when said first and second projections are received within said first and second openings, said elastomeric member serving to dampen mechanical vibration while maintaining said seal during operation of the door.

16. The door of claim 15 wherein said second member has a pair of opposed ends each of which defines a lateral bore, said assembly further comprising a shaft receivable within said bore, a roller, and a retainer clip for removably securing said roller to said shaft.

* * * * *